United States Patent [19]

Segerstrom et al.

[11] Patent Number: 4,889,540

[45] Date of Patent: Dec. 26, 1989

[54] APPARATUS FOR DETERMINATION OF SLAG TAP BLOCKAGE

[75] Inventors: Clifford C. Segerstrom, Houston, Tex.; Jacob H. Stil; Pieter J. Schuurman, both of The Hague, Netherlands; Günter K. Eckstein, Hamburg, Fed. Rep. of Germany

[73] Assignee: Shell Oil Company, Houston, Tex.

[21] Appl. No.: 356,905

[22] Filed: May 23, 1989

Related U.S. Application Data

[62] Division of Ser. No. 112,307, Oct. 26, 1987, Pat. No. 4,834,778.

[51] Int. Cl.[4] ..... C10J 3/48

[52] U.S. Cl. ..... 48/77; 48/87

[58] Field of Search ..... 48/197 R, 203, 206, 48/210, 69, DIG. 2, 77, 87; 110/171, 344, 347, 165 R; 75/0.5 R, 24; 266/44, 45, 46, 89, 160, 236; 252/373

[56] References Cited

U.S. PATENT DOCUMENTS

| | | | |
|---|---|---|---|
| 3,881,885 | 5/1975 | Wagner | 48/76 |
| 4,033,730 | 7/1977 | Baron et al. | 48/86 R |
| 4,331,400 | 5/1982 | Elliott | 48/210 |
| 4,437,864 | 3/1984 | Garris et al. | 48/62 R |
| 4,605,423 | 8/1986 | Kong | 48/DIG. 2 |
| 4,750,435 | 6/1988 | Mayes | 48/DIG. 2 |

OTHER PUBLICATIONS

EPRI Report AP-3129 (1983), Hartman et al., p. 7-7.
EPRI Report AP-4680, Proceedings: 5th Annual . . . Conference on Coal Gasification, 1985, pp. 7-6, 7-15.
Hydrocarbon Processing (1984), vol. 63, No. 4, p. 96.

*Primary Examiner*—Peter Kratz

[57] ABSTRACT

A method and apparatus for determining blockage of a coal gasification slag tap by observing changes in the pressure differential across a diaphragm seal located within an annulus formed by a pressurized vessel and a gasifier contained therewithin.

4 Claims, 1 Drawing Sheet

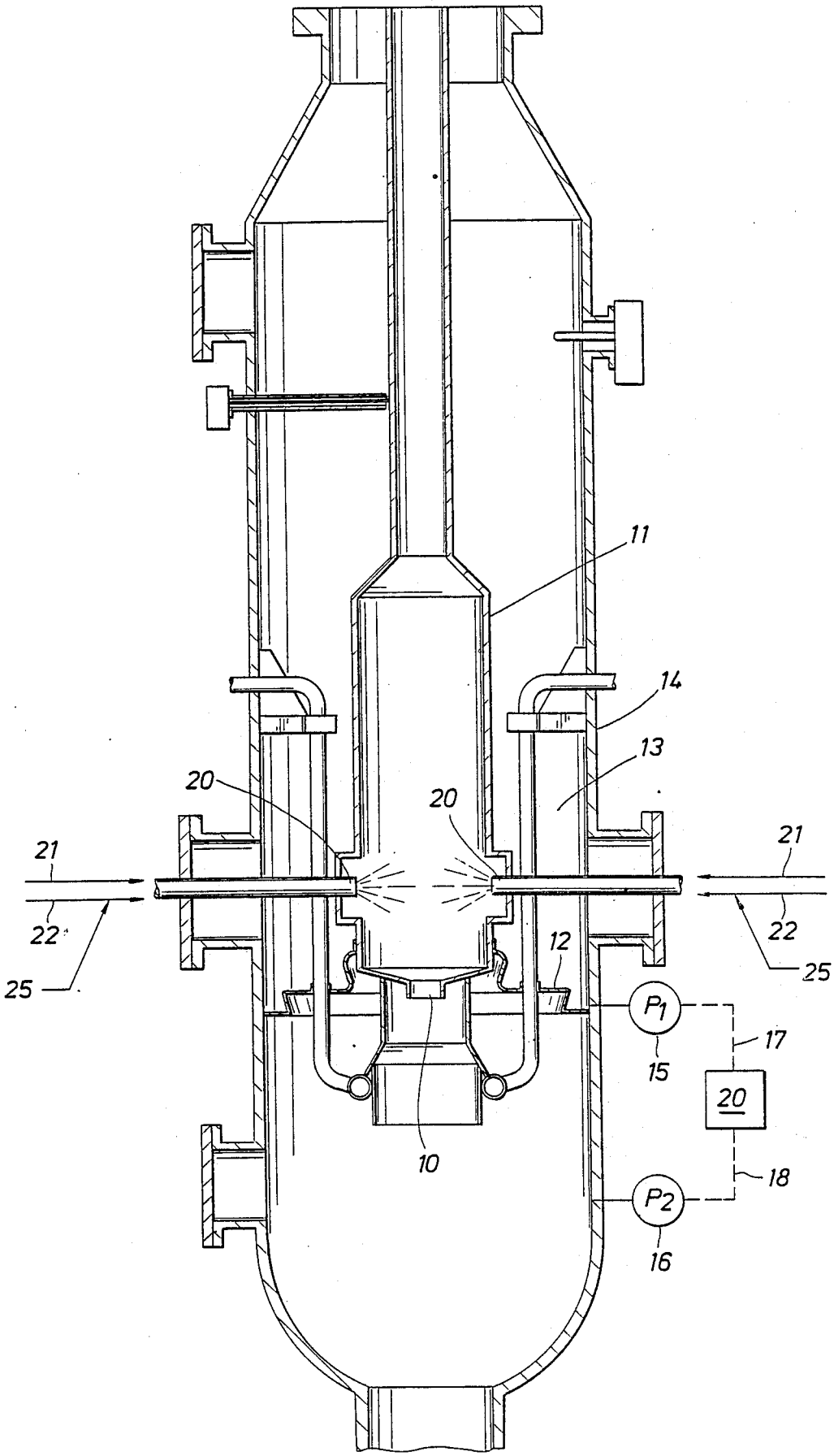
11
14
13
20
20
21
21
22
22
25
25
12
P1
15
17
20
10
18
P2
16

APPARATUS FOR DETERMINATION OF SLAG TAP BLOCKAGE

This is a division of application Ser. No. 112,307, filed Oct. 26, 1987, now U.S. Pat. No. 4,834,778.

BACKGROUND OF THE INVENTION

This invention relates to a process for complete or partial combustion of carbon-containing fuel with an oxygen-containing gas in a reactor under high pressures and temperatures in which the gas formed is removed at the top of the reactor and slag at the bottom of the reactor. The invention also relates to a reactor for use in the process.

Since carbon-containing fuel is usually of mineral origin, it invariably also contains, in addition to carbon and hydrogen, a certain quantity of inorganic, incombustible material often referred to by the term "ash" which is separated during the complete or partial combustion of mineral fuel. The residual ash collects as a molten slag and iron in the hearth of the reactor from which it is discharged (commonly known as slag-tapping) downward through a slag tap outlet or orifice in the hearth into a water bath.

Sometimes the molten slag and iron solidifies within the slag tap orifice thus causing a blockage of the orifice which prevents a satisfactory slag tapping operation.

The present invention is directed to overcoming this problem.

Applicants are not aware of any prior art which, in their judgment as persons skilled in this particular art, would anticipate or render obvious the present invention. However, for the purpose of fully developing the background of the invention, and establishing the state of requisite art, the following art is set forth: U.S. Pat. Nos. 4,437,864; 4,033,730 and 3,881,885.

SUMMARY OF THE INVENTION

The primary purpose of the present invention relates to detecting blockage of a slag tap region of a vessel, such as a gasifier operated under elevated temperature and pressure.

Preferably, such an apparatus includes means for installing a sealing means within an annulus formed by a coal gasification reactor contained within a pressurized vessel, means for beginning operation of the reactor, means for determining a first differential pressure across the sealing means upon beginning operation of the reactor, means for determining a second differential pressure across the sealing means after operating the reactor, means for comparing the first and second differential pressures to determine slag tap blockage, and means for adjusting operations of the coal gasification process to reduce slag tap blockage, the means for adjusting including at least one of: means for adding calcium to said gasifier, means for changing a weight ratio of oxygen to coal introduced to the reactor, and means for tilting burners of the reactor downwardly towards the slag tap.

Preferably, such a method includes (a) installing a sealing means within an annulus formed between a coal gasification reactor contained within a pressurized vessel, (b) beginning operation of the reactor, (c) determining a first differential pressure across the sealing means upon beginning operation of the reactor, (d) determining a second differential pressure across the sealing means after operating the reactor, (e) comparing the first and second differential pressures to determine slag tap blockage, and (f) adjusting operations of the coal gasification process to reduce slag tap blockage, the adjusting including at least one of: adding calcium to the gasifier, changing a weight ratio of oxygen to coal introduced to the reactor, and tilting burners of the reactor downwardly towards the slag tap.

The various features of novelty which characterize the invention are pointed out with particularity in the claims forming a part of this disclosure. For a better understanding of this invention, its operating advantages and specific object obtained by its use, reference may be made to the accompanying drawings and descriptive matter in which there are illustrated preferred embodiments of the invention.

BRIEF DESCRIPTION OF THE DRAWING

FIG. 1 illustrates a preferred embodiment.

DESCRIPTION OF A PREFERRED EMBODIMENT

Generation of synthesis gas occurs by combining carbon-containing fuel, such as coal, at relatively high temperatures in the range of 800° to 2000° C. and at a pressure range of from about 1–200 bar in the presence of oxygen or oxygen-containing gases in a reactor known as a gasifier, hereinafter referred to as a gasifier.

Steam, carbon monoxide, carbon dioxide, and oxygen-containing gases including air, oxygen-enriched air, and oxygen are optionally diluted with nitrogen and/or inert gases.

The combustion may be complete or partial, the object of the combustion process being in the first case the production of heat, for example, for direct or indirect power generation and in the second case, the production of synthesis gas mainly consisting of carbon monoxide and hydrogen.

In the present invention, the ash, which is the inorganic, incombustible material, is separated from the fuel during the combustion of the mineral fuel. Depending on the operating conditions under which combustion takes place, in particular the temperature and the quality of the fuel, the ash is mainly obtained in solid or liquid condition or in a combination thereof. The larger part of the liquid ash obtained, further referred to as slag, flows along the reactor wall, through a discharge opening, often referred to as a slag tap, and is generally collected in a water bath located below the slag tap of the reactor, where the slag is collected, solidified, and subsequently discharged.

The slag tap should be rather narrow for various reasons. First, the escape of unconverted coal through the discharge opening should be avoided as much as possible. Second, the slag discharge opening should prevent water vapor formed during the cooling of the slag in the water bath from entering the reactor in excessive quantities. The penetration of the water vapor into the reactor could unfavorably affect the combustion process when it enters the reactor in substantial quantities. Moreover, the water vapor will have a solidifying effect on the slag in the reactor resulting in the slag flow to the slag discharge opening being reduced.

Depending upon the conditions in the reactor such as the type of carbon-containing fuel used, the slag will more or less easily flow to the slag tap and subsequently enter the cooling water bath. However, if the slag flow through the slag tap is reduced it may cause blockage of the slag tap. If the slag tap becomes blocked, the slag will accumulate in the reaction zone and the combustion process must be interrupted to clean the slag tap. Apart from the loss of production involved in interruption of the process, there is also poor accessibility of the reactor owing to the high process temperature and pressure, which will result in the cleaning of the slag tap being a complicated and time consuming matter.

In the present invention, changes in the differential pressure across a diaphragm installed within an annulus formed by a coal gasification reactor contained within a pressurized vessel allows the determination of blockage of the slag tap. Based on the observed differential pressure upon beginning the operation of the gasifier with a clean slag tap, increases in the differential pressure generally indicate blockage of the slag tap.

An advantage of the present invention is the capability of controlling the blockage of the slag tap thus extending the time periods between shutdown of the gasifier and providing the flexibility of operating the process under various conditions such as a range of pressures, temperatures, and types of coal which characteristically produce different amounts of slag.

Although the invention is described hereinafter primarily with reference to particulate coal, the method and apparatus according to the invention are also suitable for other catalysts or finely divided particulate reactive solids such as those which can be combusted, as for example, lignite, anthracite, bituminous brown coal, soot, petroleum coke, and the like. Preferably, the size of the solid carbonaceous fuel is such that about 90 percent by weight of the fuel has a particle size smaller than 100 mesh (A.S.T.M).

Having thus generally described the apparatus and method of the present invention, as well as its numerous advantages over the art, the following is a more detailed description thereof, given in accordance with specific reference to the drawings. However, the drawings are of a process flow type in which auxiliary equipment, such as pumps, compressors, cleaning devices, etc. are not shown. All values are merely exemplary or calculated.

Referring to FIG. 1 of the drawing, an apparatus for determining blockage of a slag tap 10 of a coal gasification reactor or gasifier 11 (lower portion shown) generally includes sealing means, say a diaphragm 12, installed within an annulus 13 formed by the gasifier 11 contained in a pressurized vessel 14. The geometry of the sealing means is selected such that easier cleanout is obtained with the lowest part of the diaphragm adjacent to the pressurized vessel wall.

Upon initial start-up of the gasifier 11, the slag tap 10 is relatively clean, i.e. free of slag.

Soon after starting-up the gasifier, a first differential pressure across the diaphragm 12 is determined. The differential pressure can be determined using pressure transducers 15 and 16 transmitting signals, shown for ease of illustration as dashed lines 17 and 18, respectively, to a processor-controller 20 or in any other manner well known to the art.

After operating the gasifier 11 in the manner previously described, a second differential pressure across the diaphragm 12 is determined.

The first and second differential pressures are compared by the processor-controller 20 with a preselected value selected as an indication that blockage of the slag tap is occurring. If the preselected value is not obtained, then subsequent determinations of differential pressure are continued until the preselected value is obtained indicating that slag tap blockage is occurring.

When the preselected value is obtained, the processor-controller 20 adjusts the operating conditions of the coal gasification process.

For example, the blockage of the slag tap 10 can be controlled by adjusting the temperature of the gasifier 11. Adding calcium, such as limestone 25, reduces the melting temperature of the slag thereby reducing the viscosity of the molten slag during operation of the process. Also, the weight ratio of oxygen 21 to coal 22 introduced to the gasifier can be increased thereby increasing the operating temperature of the gasifier. Furthermore, the temperature in the area in proximity of the slag tap 10 can be increased by tilting the burners 20 of the gasifier 11 downwardly towards the slag tap 10 area.

Although the system for the present invention is shown in FIG. 1 in its distributed form as discrete components, it would be readily understood by those skilled in the art that these components could be combined into a single unit or otherwise implemented as may be most convenient for the particular application at hand. Furthermore, although the preferred embodiment has been shown as using an electronic transmitting system, it is also understood by those skilled in the art that the present invention could be effected using manual or pneumatic controls.

The foregoing description of the invention is merely intended to be explanatory thereof, and various changes in the details of the described method and apparatus may be made within the scope of the appended claims without departing from the spirit of the invention.

What is claimed is:

1. An apparatus for preventing blockage of a slag tap in a coal gasification reactor contained within a pressure vessel whereby a pressurized annulus is formed between said reactor and said pressure vessel, said apparatus comprising:

a diaphragm fixedly and sealingly attached between the outer walls of said gasifier and the inner walls of said pressure vessel thereby dividing said pressurized annulus into an upper and a lower pressurized annulus, said lower pressurized annulus being in open communication with said reactor downstream of said slag tap;

a pressure transducer for measuring the pressure within said upper pressurized annulus;

a pressure transducer for measuring the pressure within said lower pressurized annulus;

means for determining the pressure difference between said pressure transducers; and means, responsive to said differential pressure-determining means, for adjusting the operating conditions of said reactor.

2. The apparatus of claim 1 wherein said diaphragm is located proximate to said slag tap.

3. The apparatus of claim 1 wherein said means for adjusting comprises means for adding calcium to said reactor.

4. The apparatus of claim 1 wherein said means for adjusting comprises means for adjusting the weight ratio of oxygen to coal input to said reactor.

* * * * *